US008395474B2

(12) United States Patent
Tanba et al.

(10) Patent No.: US 8,395,474 B2
(45) Date of Patent: Mar. 12, 2013

(54) POSITION SENSOR CORD, POSITION SENSOR AND PLANAR POSITION SENSOR

(75) Inventors: Akihiro Tanba, Hitachinaka (JP); Takashi Aoyama, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 13/348,956

(22) Filed: Jan. 12, 2012

(65) Prior Publication Data

US 2012/0182117 A1 Jul. 19, 2012

(30) Foreign Application Priority Data

Jan. 13, 2011 (JP) ..... 2011-005000

(51) Int. Cl.
*H01C 10/10* (2006.01)

(52) U.S. Cl. ..... 338/47; 338/114; 338/210

(58) Field of Classification Search ..... 338/47, 338/210, 214

See application file for complete search history.

(56) References Cited

U.S. PATENT DOCUMENTS

| | | | | |
|---|---|---|---|---|
| 5,801,347 | A * | 9/1998 | Tsuge et al. | 200/61.44 |
| 6,078,014 | A | 6/2000 | Kashiwazaki et al. | |
| 6,107,580 | A * | 8/2000 | Hoshikawa et al. | 200/61.43 |
| 6,166,338 | A * | 12/2000 | Ebato | 200/61.43 |
| 6,201,468 | B1 * | 3/2001 | DeVolpi | 338/47 |
| 6,316,846 | B1 | 11/2001 | Kashiwazaki et al. | |
| 7,150,179 | B2 * | 12/2006 | Takafuji et al. | 73/12.09 |
| 7,534,957 | B2 * | 5/2009 | Yamaura et al. | 174/36 |
| 7,554,045 | B2 * | 6/2009 | Sandbach et al. | 200/61.43 |

FOREIGN PATENT DOCUMENTS

JP 2005-302736 A 10/2005

* cited by examiner

*Primary Examiner* — Kyung Lee
(74) *Attorney, Agent, or Firm* — Robert Mlotkowski Safran & Cole P.C.

(57) ABSTRACT

A position sensor cord includes a hollow insulator formed of a restorable rubber or a restorable plastic, and two linear resistive members. Each of the two linear resistive members includes a linear insulator and a conductive layer provided around a circumference of the linear insulator. The conductive layer is formed of a conductive rubber or a conductive plastic. The two linear resistive members are arranged in no electrical contact with each other and along an inner surface of the hollow insulator. One of the two linear resistive members may be replaced with one linear conductive member.

11 Claims, 4 Drawing Sheets

POSITION SENSOR CORD, POSITION SENSOR AND PLANAR POSITION SENSOR

The present application is based on Japanese patent application No. 2011-005000 filed on Jan. 13, 2011, the entire contents of which are incorporated herein by reference.

BACKGROUND OF THE INVENTION

1. Field of the Invention

This invention relates to a position sensor cord, a position sensor and a planar position sensor.

2. Description of the Related Art

In general, a device for opening and closing a door or the like is mounted with a pinch sensor for detecting that an object, a person or the like (herein, referred to as "object or person") is pinched or trapped in an opening and closing portion of the device. The pinch sensor is also called as foreign object detection sensor, anti-trap protection sensor, pressure sensor, or the like.

This pinch sensor has been developed to be mountable to an uneven surface so that the degree of freedom of mount thereof is high, and to have a lengthy structure with a length of several meters or more.

For example, JP-A-2005-302736 discloses a conventional pressure sensor.

SUMMARY OF THE INVENTION

However, a so-called "cord switch" (i.e. a cord-type cable having a switching function) for the pinch sensor disclosed by JP-A-2005-302736 detects only ON/OFF operation when a pressure is applied thereto, but fails to detect a position at which the pressure has is applied thereto by the object or person.

On the other hand, as the conventional position sensor which detects the position at which the pressure is applied thereto by the object or person, a position sensor having a following structure has been known. Namely, in this position sensor, two resistive elements comprising a conductive rubber are arranged parallel to each other, and one end of one of the resistive elements and one end of the other of the resistive elements are electrically connected to each other while a power supply is connected between the respective other ends of the resistive elements to form an electrical circuit, to detect a variation in resistance value of the electrical circuit, thereby detect the position at which the pressure is applied thereto by the object or person.

However, as to the position sensor having the aforementioned structure, there is a disadvantage in that it is difficult to provide the lengthy structure with the length of several meters or more.

Accordingly, it is an object of the present invention to provide a position sensor cord, a position sensor and a planar position sensor, which are mountable to an uneven surface so that the degree of freedom of mount thereof is high, and which has a lengthy structure with a length of several meters or more.

According to a first feature of the invention, a position sensor cord comprises:

a hollow insulator comprising a restorable rubber or a restorable plastic; and two linear resistive members, each of the two linear resistive members comprising a linear insulator and a conductive layer provided around a circumference of the linear insulator, the conductive layer comprising a conductive rubber or a conductive plastic, in which the two linear resistive members are arranged in no electrical contact with each other and along an inner surface of the hollow insulator.

The linear resistive members may be arranged in a helical shape in a longitudinal direction.

According to a second feature of the invention, a position sensor cord comprises:

a hollow insulator comprising a restorable rubber or a restorable plastic;

a linear resistive member comprising a linear insulator and a conductive layer provided around a circumference of the linear insulator, the conductive layer comprising a conductive rubber or a conductive plastic; and a linear conductive member comprising a conductor and a conductive layer provided around a circumference of the conductor, the conductive layer comprising a conductive rubber or a conductive plastic, in which the linear resistive member and the linear conductive member are arranged in no electrical contact with each other and along an inner surface of the hollow insulator.

The linear resistive member and the linear conductive member may be arranged in a helical shape in a longitudinal direction.

According to a third feature, a position sensor cord comprises:

a hollow insulator comprising a restorable rubber or a restorable plastic;

two linear members, at least one of the two linear members comprising a linear resistive member, the linear resistive member comprising a linear insulator and a conductive layer provided around a circumference of the linear insulator, the conductive layer comprising a conductive rubber or a conductive plastic, in which the two linear members are arranged in no electrical contact with each other and along an inner surface of the hollow insulator.

Another one of the two linear member may comprise a linear conductive member comprising a conductor and a conductive layer provided around a circumference of the conductor, the conductive layer comprising a conductive rubber or a conductive plastic.

Each of the two linear members may comprise the linear resistive member.

According to a fourth feature of the invention, a position sensor comprises:

a position sensor cord according to the first feature;

a connecting member for electrically connecting respective ends of the two linear resistive members at one end of the position sensor cord;

a power supply connected between respective ends of the two linear resistive members at an other end of the position sensor cord; and a resistance value detecting circuit for detecting a resistance value of an electrical circuit formed by the two linear resistive members and the power supply, in which when a pressure is applied to the position sensor cord, the position sensor detects a variation in the resistance value of the electrical circuit with the resistance value detecting circuit, and thereby detects a position where the pressure is applied in a longitudinal direction of the position sensor cord.

According to a fifth feature of the invention, a position sensor comprises:

a position sensor cord according to the second feature;

a connecting member for electrically connecting respective an end of the linear resistive member and an end of the linear conductive member at one end of the position sensor cord;

a power supply connected between an end of the linear resistive member and an end of the linear conductive member at an other end of the position sensor cord; and a resistance value detecting circuit for detecting a resistance value of an electrical circuit formed by the linear resistive member, the linear conductive member and the power supply, in which when a pressure is applied to the position sensor cord, the position sensor detects a variation in the resistance value of the electrical circuit with the resistance value detecting circuit, and thereby detects a position where the pressure is applied in a longitudinal direction of the position sensor cord.

According to a sixth feature, a planar position sensor comprises:

a plurality of position sensors according to the fourth feature, in which the plurality of position sensors are installed in such a manner that the respective position sensor cords are arranged in parallel to each other.

According to a seventh feature, a planar position sensor comprises:

a plurality of position sensors according to the fifth feature, in which the plurality of position sensors are installed in such a manner that the respective position sensor cords are arranged in parallel to each other.

(Points of the Invention)

The position sensor cord (i.e. a cord-type cable for a sensor for position detection) is a rubber or plastic-based cable with excellent flexibility, and is therefore mountable to an uneven surface. According to the first embodiment of the invention, since a linear insulator as a core member in the extrusion coating of the conductive layer, even the conductive rubber or conductive plastic with a low mechanical strength can be extrusion-coated over several meters or more, so that the position sensor cord has the lengthy structure.

According to the second embodiment of the invention, it is possible to avoid an excessive increase in the resistance of the position sensor cord, and therefore make the position sensor cord suitable for more elongation.

BRIEF DESCRIPTION OF THE DRAWINGS

The preferred embodiments according to the invention will be explained below referring to appended drawings, wherein.

DETAILED DESCRIPTION OF THE PREFERRED EMBODIMENTS

Next, preferred embodiments according to the invention will be explained in more detail in conjunction with the appended drawings.

First Embodiment

Figure 1:
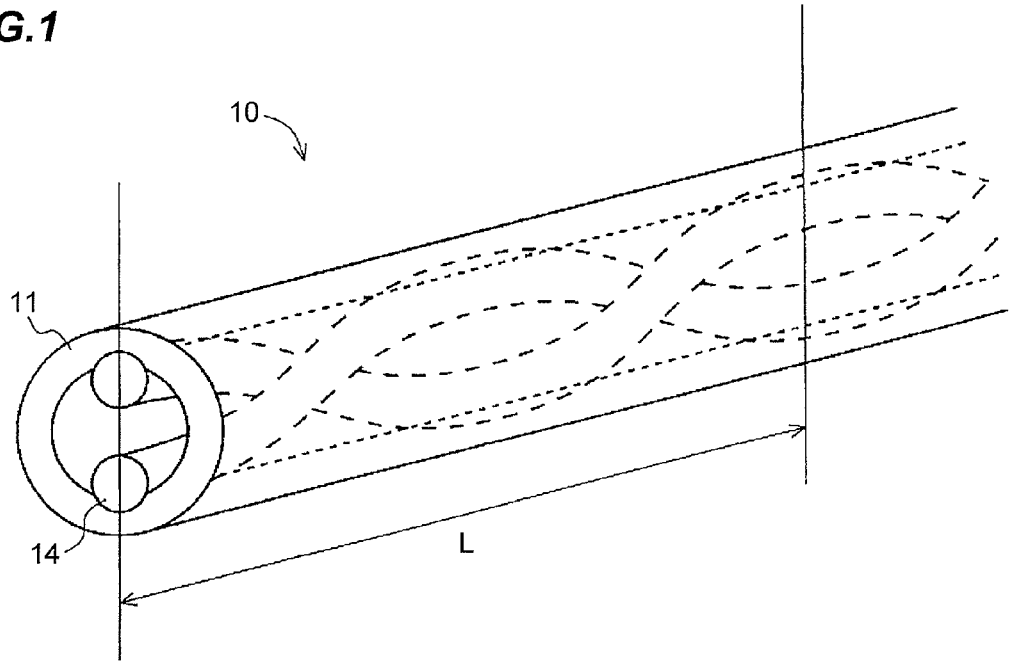
FIG. 1 is a perspective view showing a position sensor cord in the first embodiment according to the invention.
Figure 2:
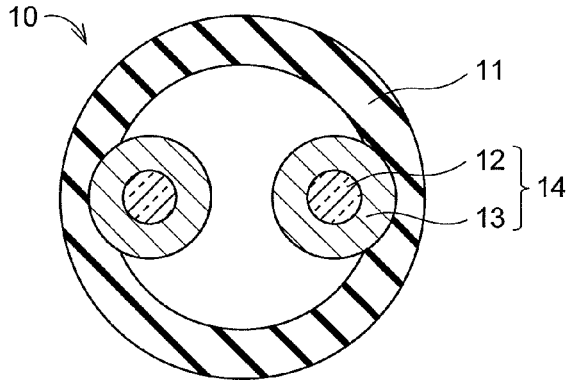
FIG. 2 is a transverse cross sectional view showing the position sensor cord in the first embodiment according to the invention.

FIG. 1 is a perspective view showing a position sensor cord 10 in the first embodiment according to the invention, and FIG. 2 is a transverse cross sectional view thereof.

Herein, the so-called "position sensor cord" is a cord-type cable adapted for a position sensor. The position sensor is formed by using the position sensor cord.

(Structure of a Position Sensor Cord 10)

Referring to FIGS. 1 and 2, the position sensor cord 10 in the first embodiment includes a hollow insulator 11 formed of a restorable rubber or a restorable plastic, and two linear resistive members 14 arranged in no electrical contact with each other and in a helical shape having a length L (e.g. L=5 to 6 mm) of one period in a longitudinal direction along an inner surface of the hollow insulator 11. Each linear resistive member 14 comprises a linear insulator 12 formed of an insulator, and an electrically conductive layer (hereinafter referred to as "conductive layer") 13 provided around a circumference of the linear member 12. The conductive layer 13 is formed of an electrically conductive rubber (hereinafter referred to as "conductive rubber") or an electrically conductive plastic (hereinafter referred to as "conductive plastic").

The hollow insulator 11 holds and fixes the two linear resistive members 14 in no electrical contact with each other and in the helical shape. The hollow insulator 11 is easily deformed by an external force, and immediately restored when the external force is released.

As the restorable rubber for forming this hollow insulator 11, urethane rubber, ethylene propylene rubber, styrene butadiene rubber, chloroprene rubber or the like may be used.

Also, as the restorable plastic for forming the hollow insulator 11, polyethylene, ethylene vinyl acetate copolymer, ethylene ethyl acrylate copolymer, ethylene methyl methacrylate copolymer, polypropylene, poly vinyl chloride, and olefin or styrene based thermoplastic elastomer may be used. Further, even an engineering plastic, such as a polyimide, a polyamide or the like, may be used as the restorable plastic for the hollow insulator 11, by designing shape, thickness, and lamination with another material.

As the insulator for forming the linear insulator 12, glass fiber, cotton yarn, carbon fiber, and super engineering plastics, such as polyphenylene sulfide and the like may be used.

The conductive layer 13 is formed by extrusion-coating of the conductive rubber or the conductive plastic around the circumference of the linear insulator 12. The conductive rubber or the conductive plastic comprises a combination of the restorable rubber or the restorable plastic for forming the hollow insulator 11 and a conductive filler such as carbon black or the like.

The position sensor cord 10 is the rubber or plastic-based cable with excellent flexibility, and is therefore mountable to an uneven surface. In the extrusion-coating of the conductive layer 13, the linear insulator 12 functions as a core member (a center wire). Therefore, even the conductive rubber or conductive plastic generally having the low mechanical strength can be extrusion-coated over several meters or more, so that the position sensor cord 10 may have a lengthy structure.

(Position Sensor 30)

Next, a position sensor 30 using the position sensor cord 10 will be explained below.

Figure 3:
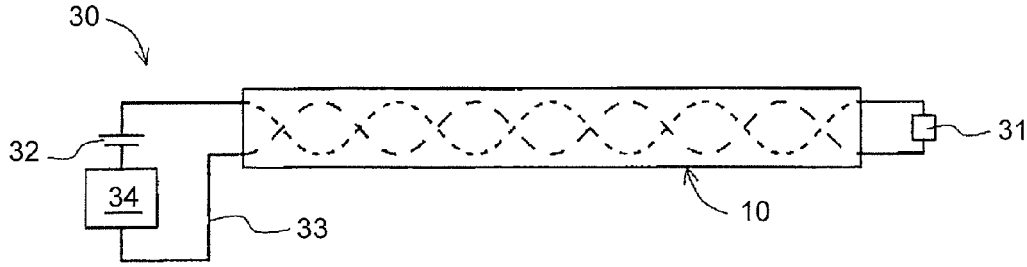
FIG. 3 is a schematic diagram showing a position sensor in the first embodiment according to the invention.

Referring to FIG. 3, the position sensor 30 in the first embodiment includes the position sensor cord 10 as described above, a connecting member 31 for electrically connecting respective ends of two linear resistive members 14 at one end (in FIG. 3, right end) of the position sensor cord 10, a power supply 32 connected between respective ends of the two linear resistive members 14 at the other end (in FIG. 3, left end) of the position sensor cord 10, and a resistance value detecting circuit 34 for detecting a resistance value of an electrical circuit 33 formed by the two linear resistive members 14 and the power supply 32. When a pressure is applied to the position sensor cord 10, the position sensor 30 detects a variation in the resistance value of the electrical circuit 33 with the resistance value detecting circuit 34, and thereby detects the position where the pressure is applied in a longitudinal direction of the position sensor cord 10.

The connecting member 31 comprises a conductive material, e.g. a metal such as copper, aluminum or the like. The connecting member 31 is provided for shorting the respective ends of the two linear resistive members 14 at the one end of the position sensor cord 10. A resistor may be used as the connecting member 31, so that the respective ends of the two linear resistive members 14 may be electrically connected to each other by this resistor. Also, the respective ends of the two linear resistive members 14 may be electrically connected to each other by simply crimping, caulking the one end of the position sensor cord 10. In this case, the step for connecting the conductive material or resistor can be omitted, so that the production can be facilitated.

The resistance value detecting circuit 34 continuously (i.e. constantly) measures the electric current flown through the electrical circuit 33. The resistance value detecting circuit 34 is provided for detecting the resistance value of the electrical circuit 33 based on the measured electric current value and the voltage applied by the power supply 32.

In the position sensor 30, when the pressure is applied to a portion of the position sensor cord 10, the two linear resistive members 14 are short-circuited in that portion to which the pressure is applied, so that the electric current value measured by the resistance value detecting circuit 34 varies. As a result, the detected resistance value varies.

Based on the variation in the detected resistance value, it is possible to determine at which position in the longitudinal direction of the position sensor cord 10 the two linear resistive members 14 are short-circuited. In other words, when the pressure is applied to the position sensor cord 10, the position sensor 30 can detect the position where the pressure is applied.

Figure 4:
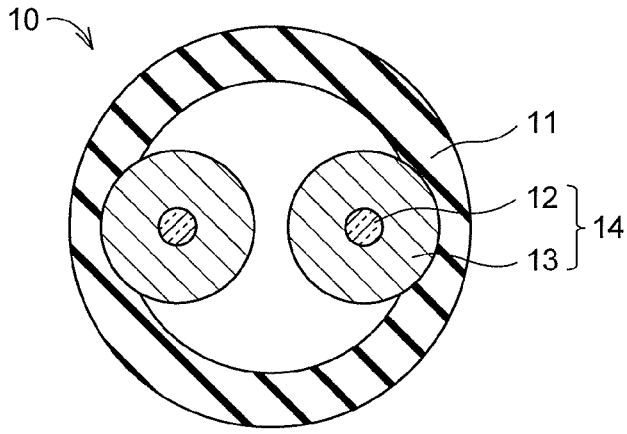
FIG. 4 is a transverse cross sectional view showing a position sensor cord in a modification to the invention.

In the position sensor cord 30 as shown in FIG. 4, the cross sectional area of the conductive layers 13 is increased compared with the cross sectional area of the conductive layers 13 in the position sensor cord as shown in FIG. 2. Variation in the cross sectional area of the conductive layers 13 of the position sensor cord 10 results in a variation in the resistance per unit length. Based on this phenomenon, it is possible to vary the detection sensitivity of the position sensor 30 by varying the cross sectional area of the conductive layers 13.

For example, in the case that the electrical resistivity p of the conductive layers 13 is 0.6 Ω·cm, when the cross sectional area of the conductive layers 13 is equivalent to a cross sectional area of a conductive wire with a diameter of 0.5 mm, the resistance per unit length is 306 Ω/cm, and when the cross sectional area of the conductive layers 13 is equivalent to a cross sectional area of a conductive wire with a diameter of 3 mm, the resistance per unit length thereof is 849 Ω/m.

In the first embodiment, the number of linear resistive members 14 is two (2). However, the present invention is not limited thereto. The number of linear resistive members 14 may be four (4).

Second Embodiment

A position sensor cord 10 in the second embodiment will be explained below.

The position sensor cord 10 in the first embodiment comprises the hollow insulator 11 and the two linear resistive members 14 arranged in the helical shape in the longitudinal direction along the inner surface of the hollow insulator 11.

The position sensor cord 10 in the second embodiment is similar to that in the first embodiment, except a linear conductive member 16 is used.

Figure 5A:
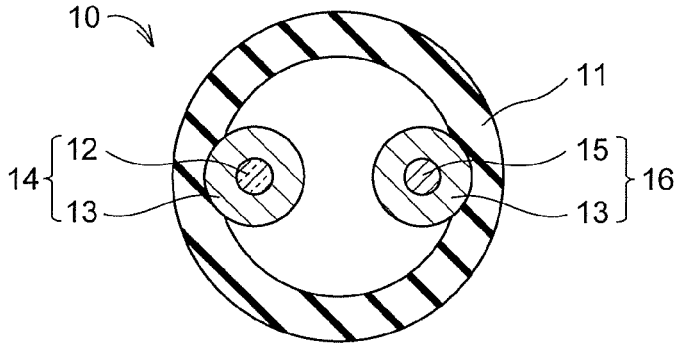
FIGS. 5A and 5B are transverse cross sectional views showing position sensor cords in the second embodiment according to the invention.

For example, as shown in FIG. 5A, one of the two linear resistive members 14 in the first embodiment is replaced with a linear conductive member 16 comprising a conductor 15 and the conductive layer 13 provided around the circumference of the conductor 15.

According to the structure as shown in FIG. 5A, since an excessive increase in the resistance of the position sensor cord 10 can be suppressed, it is possible to provide the position sensor cord 10 which is suitable for more elongation.

Figure 5B:
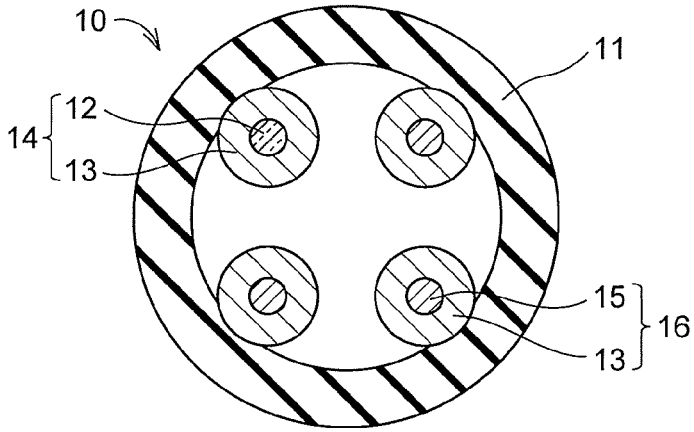

Referring to FIG. 5B, one to three (three in FIG. 5B) of the four linear resistive members 14 in the first embodiment may be replaced with the linear conductive members 16 respectively.

In the first and second embodiments of the present invention, the linear resistive member 14 and the linear conductive member 16 may be collectively called as "linear members". In the first and second embodiments, at least one pair of linear members (e.g. two or four linear members) are arranged in no electrical contact with each other in a longitudinal direction along an inner surface of the hollow insulator 11, and at least one of the linear members is the linear resistive member 14. Namely, two linear members may be a pair of two linear resistive member 14, or a pair of one linear resistive member 14 and one linear conductive member 16. The number of the linear resistive members 14 in four linear members may be from one to three. According to this structure, it is possible to provide the position sensor cord 10 with the flexibility and the mechanical strength. By increasing the number of the linear conductive members 16 in the four linear members, it is possible to suppress the excess increase in the resistance.

Third Embodiment

Figure 6:
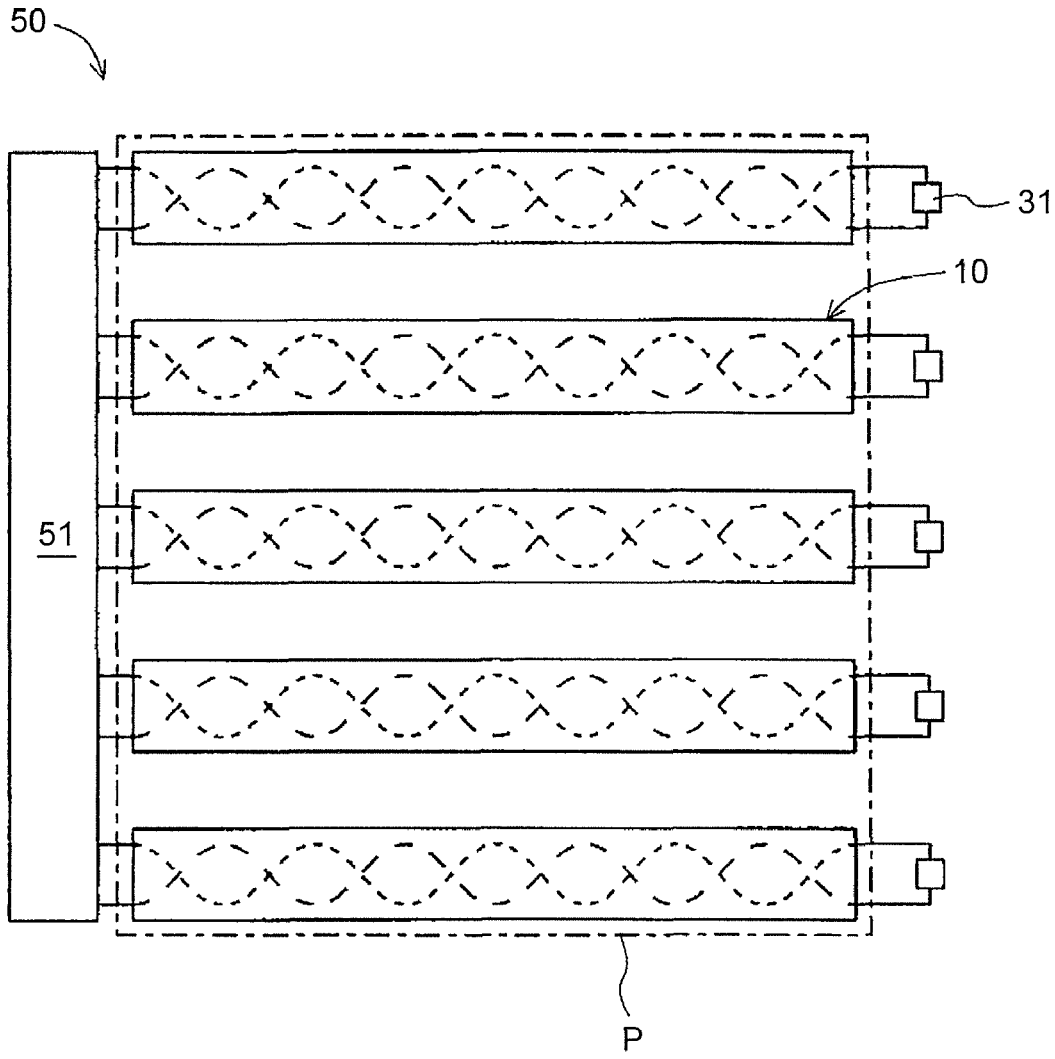
FIG. 6 is a schematic diagram showing a planar position sensor in the third embodiment according to the invention.

FIG. 6 shows a planar position sensor 50 in the third embodiment.

(Planar Position Sensor 50)

Referring to FIG. 6, a planar position sensor 50 is formed by installing a plurality of the position sensors 30 in such a manner that the respective position sensor cords 10 are arranged in parallel to each other. According to this structure, it is possible to detect a schematic position in a plane P.

In the planar position sensor 50 (referred to as "the planar position sensor shown in FIG. 6"), the power supplies 32 and the resistance value detecting circuits 34 are converged on one end terminal 51. According to this structure, based on a variation in a resistance value of each position sensor cord 10, it is possible to detect the specific position sensor cord 10 to which the pressure is applied, and the position where the pressure is applied, thereby the schematic position thereof in the plane P.

(Modification)

The planar position sensor 50 in the third embodiment is not limited to the above described configuration, but may be altered as follows.

In the above described configuration, the plural position sensor cords 10 are arranged independently from each other. However, the present invention is not limited thereto. For example, as shown in FIG. 7, The plural position sensor cords 10 may be connected in series to each other, to configure a planar position sensor 50 (referred to as "the planar position sensor 50 shown in FIG. 7").

On one hand, the planar position sensor 50 as shown in FIG. 6 requires the plurality of power supplies 32, the plurality of connecting members 31 and the plurality of resistance value detecting circuits 34 for the plurality of position sensor cords 10 respectively installed to be arranged in parallel to each other. On the other hand, the planar position sensor 50 as shown in FIG. 7 allows reduction in the number of each of these elements 32, 31, and 34 to one. Therefore, it is possible to provide the lower cost planar position sensor 50.

Figure 7:
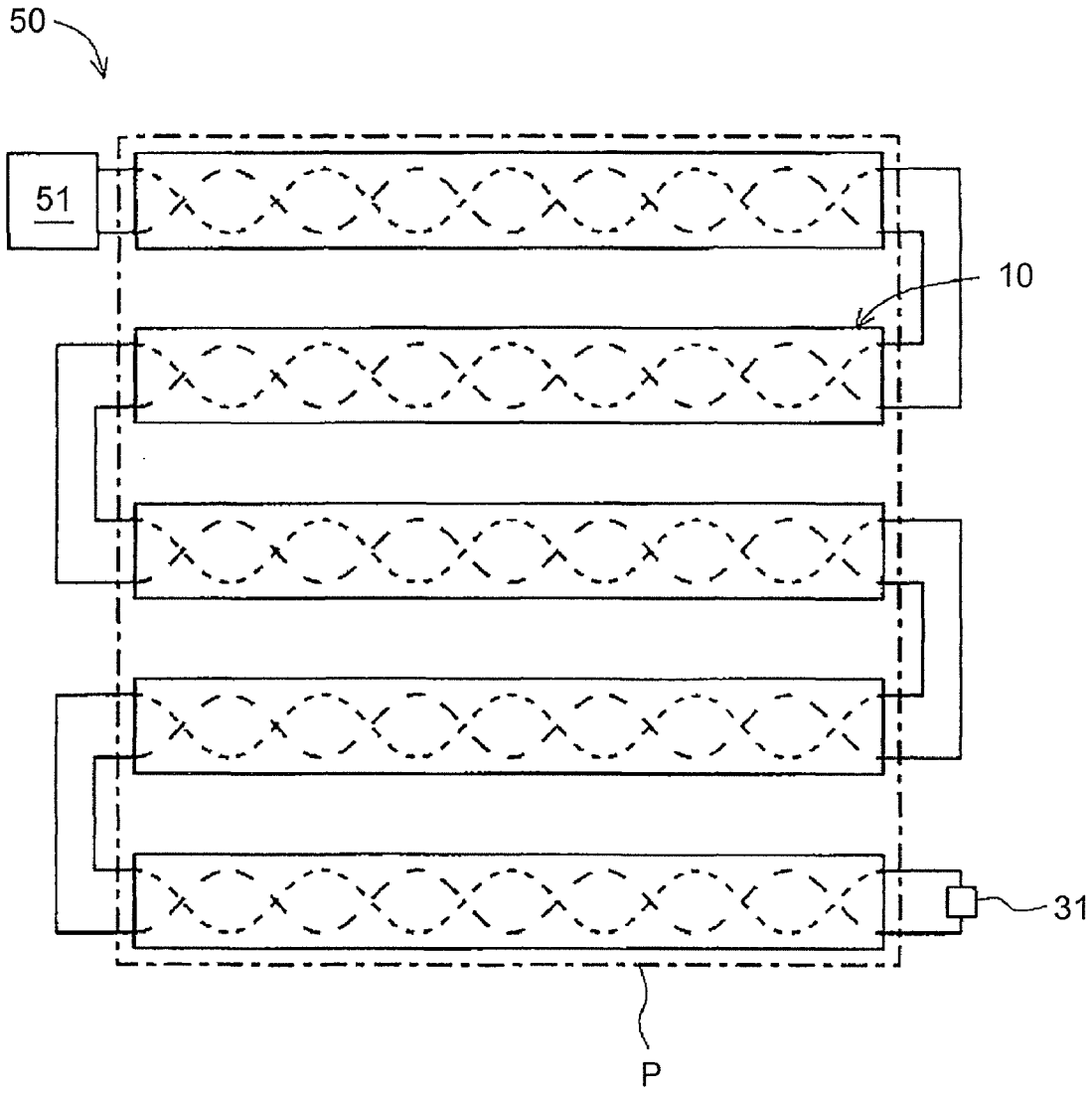
FIG. 7 is a schematic diagram showing a planar position sensor in a modification to the third embodiment according to the invention.

Since the plural position sensor cords 10 are connected in series to each other in the planar position sensor 50 as shown in FIG. 7, the latter configuration may have an excessively increased resistance depending on area to be detected. As a result, it may be difficult to detect the position where the pressure is applied. However, this problem can be suppressed by employing the planar position sensor 50 as shown in FIG. 6, because it can detect the position where the pressure is applied on each of the plural position sensor cords 10. The planar position sensor 50 may appropriately be altered to be configured as the planar position sensor 50 as shown in FIG. 6 or FIG. 7, taking account of cost and pressure application range.

Since the planar position sensor 50 can detect the position where the pressure is applied, it can be used for e.g. an intruder detection sensor, an anti-bedsore sensor for sickbeds, and the like.

As described above, the invention can provide the position sensor cord, the position sensor and the planar position sensor, which are mountable to an uneven surface so that the degree of freedom of mount thereof is high, and which can be elongated for several meters or more.

In the above embodiments, the position sensor cord 10 is used for the position sensor 30. However, the present invention is not limited thereto. The position sensor cord 10 may also be used for constituting a pressure sensitive sensor.

In this case, since the two linear resistive members 14 arranged within the hollow insulator 11 serve as resistors in the position sensor cord 10, any resistor as in the conventional cord switch is not required to be attached to the end of the position sensor cord 10. Therefore, it is possible to reduce the resistor attachment space and cost therefor, and thereby ensure size reduction and cost lowering.

Although the invention has been described, the invention according to claims is not to be limited by the above-mentioned embodiments and examples. Further, please note that not all combinations of the features described in the embodiments and the examples are not necessary to solve the problem of the invention.

What is claimed is:

1. A position sensor cord, comprising:

a hollow insulator comprising a restorable rubber or a restorable plastic; and two linear resistive members, each of the two linear resistive members comprising a linear insulator and a conductive layer provided around a circumference of the linear insulator, the conductive layer comprising a conductive rubber or a conductive plastic, wherein the two linear resistive members are arranged in no electrical contact with each other and along an inner surface of the hollow insulator.

2. The position sensor cord according to claim 1, wherein the linear resistive members are arranged in a helical shape in a longitudinal direction.

3. A position sensor cord, comprising:

a hollow insulator comprising a restorable rubber or a restorable plastic;

a linear resistive member comprising a linear insulator and a conductive layer provided around a circumference of the linear insulator, the conductive layer comprising a conductive rubber or a conductive plastic; and a linear conductive member comprising a conductor and a conductive layer provided around a circumference of the conductor, the conductive layer comprising a conductive rubber or a conductive plastic, wherein the linear resistive member and the linear conductive member are arranged in no electrical contact with each other and along an inner surface of the hollow insulator.

4. The position sensor cord according to claim 3, wherein the linear resistive member and the linear conductive member are arranged in a helical shape in a longitudinal direction.

5. A position sensor cord, comprising:

a hollow insulator comprising a restorable rubber or a restorable plastic;

two linear members, at least one of the two linear members comprising a linear resistive member, the linear resistive member comprising a linear insulator and a conductive layer provided around a circumference of the linear insulator, the conductive layer comprising a conductive rubber or a conductive plastic, wherein the two linear members are arranged in no electrical contact with each other and along an inner surface of the hollow insulator.

6. The position sensor cord according to claim 5, wherein another one of the two linear members comprises a linear conductive member comprising a conductor and a conductive layer provided around a circumference of the conductor, the conductive layer comprising a conductive rubber or a conductive plastic.

7. The position sensor cord according to claim 5, wherein each of the two linear members comprises the linear resistive member.

8. A position sensor, comprising:

a position sensor cord according to claim 1;

a connecting member for electrically connecting respective ends of the two linear resistive members at one end of the position sensor cord;

a power supply connected between respective ends of the two linear resistive members at an other end of the position sensor cord; and a resistance value detecting circuit for detecting a resistance value of an electrical circuit formed by the two linear resistive members and the power supply, wherein when a pressure is applied to the position sensor cord, the position sensor detects a variation in the resistance value of the electrical circuit with the resistance value detecting circuit, and thereby detects a position where the pressure is applied in a longitudinal direction of the position sensor cord.

9. A position sensor, comprising:

a position sensor cord according to claim 3;

a connecting member for electrically connecting respective an end of the linear resistive member and an end of the linear conductive member at one end of the position sensor cord;

a power supply connected between an end of the linear resistive member and an end of the linear conductive member at an other end of the position sensor cord; and a resistance value detecting circuit for detecting a resistance value of an electrical circuit formed by the linear resistive member, the linear conductive member and the power supply, wherein when a pressure is applied to the position sensor cord, the position sensor detects a variation in the resistance value of the electrical circuit with the resistance value detecting circuit, and thereby detects a position where the pressure is applied in a longitudinal direction of the position sensor cord.

10. A planar position sensor, comprising:

a plurality of position sensors according to claim 8, wherein the plurality of position sensors are installed in such a manner that the respective position sensor cords are arranged in parallel to each other.

11. A planar position sensor, comprising:

a plurality of position sensors according to claim 9, wherein the plurality of position sensors are installed in such a manner that the respective position sensor cords are arranged in parallel to each other.

* * * * *